US006274835B1

(12) United States Patent
Mo

(10) Patent No.: US 6,274,835 B1
(45) Date of Patent: Aug. 14, 2001

(54) SELECTOR SWITCH OPERATOR

(75) Inventor: Patrick Mo, Chicago, IL (US)

(73) Assignee: Siemens Energy & Automation, Alpharetta, GA (US)

( * ) Notice: Subject to any disclaimer, the term of this patent is extended or adjusted under 35 U.S.C. 154(b) by 0 days.

(21) Appl. No.: 09/439,484

(22) Filed: Nov. 15, 1999

(51) Int. Cl.[7] ..... H01H 19/14
(52) U.S. Cl. ..... 200/564; 200/566
(58) Field of Search ..... 200/43.08, 564, 200/566, 568

(56) References Cited

U.S. PATENT DOCUMENTS 4,376,239 * 3/1983 Long et al. ..... 200/159 B
5,049,709 * 9/1991 Prickett et al. ..... 200/527
5,736,700 * 4/1998 Takahashi et al. ..... 200/61.54
6,025,564 * 2/2000 Verduci et al. ..... 200/61.27

* cited by examiner

*Primary Examiner*—Paula Bradley
*Assistant Examiner*—Nhung Nguyen

(57) ABSTRACT

A modular selector switch operator includes a housing and a cylinder rotationally mounted in the housing. The cylinder has a radially extending follower and a circumferential cam track. A knob extends forwardly of the housing and is operatively connected to the cylinder for rotating the cylinder. A pusher is received in the housing and has a follower pin riding in the cam track to convert rotational movement of the cylinder to linear movement of the pusher for actuating an electrical switch, in use. An indexing cam ring is concentrically mounted to the cylinder in the housing in one of two orientations with the cylinder follower engaging the cam ring. A first orientation provides a maintained actuation position relative to a neutral position. A second orientation provides a momentary actuation position relative to the neutral position.

13 Claims, 3 Drawing Sheets

SELECTOR SWITCH OPERATOR

FIELD OF THE INVENTION

This invention relates to electro-mechanical switches and, more particularly, to a modular, water resistant selector switch operator.

BACKGROUND OF THE INVENTION

A selector switch is commonly used as a manually operated controller for industrial electric motor control circuits. A selector switch is typically mounted in a front panel of a control enclosure. Selector switches are used in applications where rotary knob actuation of the control circuit is desired, as opposed to push button or knife switches, for example. A knob operated selector switch has a rotatable knob that actuates an electrical switch to open and close electrical circuits.

Existing NEMA (National Electrical Manufacturers Association) industry 22 mm selector switches perform basic selector switch functions in various configurations, such as two or three actuation positions and momentary or maintained contact actuation. These switches have not generally been constructed for environmental water entry resistance required by both NEMA 4 water spray tests and NEMA 6 water submersion tests. Also, prior such switches utilize different mechanical components for the six most common switch configurations requiring additional investments in tooling and inventory for manufacturing.

The present invention is intended to overcome the problems discussed above, in a novel and simple manner.

SUMMARY OF THE INVENTION

In accordance with the invention there is provided a modular selector switch design, reducing the number of unique switch components for different switch configurations.

Broadly, there is disclosed herein a modular selector switch operator including a housing and a cylinder rotationally mounted in the housing. The cylinder has a radially extending follower and a circumferential cam track. A knob extends forwardly of the housing and is operatively connected to the cylinder for rotating the cylinder. A pusher is received in the housing and has a follower pin riding in the cam track to convert rotational movement of the cylinder to linear movement of the pusher for actuating an electrical switch, in use. An indexing cam ring is concentrically mounted to the cylinder in the housing in one of two orientations with the cylinder follower engaging the cam ring. A first orientation provides a maintained actuation position relative to a neutral position. A second orientation provides a momentary actuation position relative to the neutral position.

It is a feature of the invention that the cam ring has plural ramped surfaces for riding on the follower, the ramped surfaces that ride on the follower in the first orientation including detents for locking the cylinder to the cam ring in the maintained actuation position. A spring biases the cam ring against the follower.

It is another feature of the invention that the selector switch comprises a three position switch and the housing limits movement of the cylinder to approximately 100 degree rotation or the selector switch comprises a two position switch and the housing limits movement of the cylinder to approximately 50 degree rotation.

It is a further feature of the invention that the cam ring includes first and second axial end surfaces each having plural ramped surfaces. The ramped surfaces at the first axial end have detents. The first axial end surface engages the follower in the first orientation and the second axial end surface engages the follower in the second orientation.

It is still another feature of the invention that the cam ring is rotationally constrained in the housing.

It is an additional feature of the invention that the cam ring includes first and second axial end surfaces each having opposite pairs of intersecting ramped surfaces. One of each of the intersecting ramped surfaces has a detent. The follower is positioned proximate the intersection of the ramped surfaces in the neutral position and the ramped surface having the detent is clockwise from the intersection in the first orientation and counterclockwise from the intersection in the second orientation.

There is disclosed in accordance with another aspect of the invention a selector switch operator including a one-piece tubular barrel housing and a cylinder rotationally mounted in the housing. The cylinder has a radially extending follower and a circumferential cam track. A knob extends forwardly of the housing and is operatively connected to the cylinder for rotating the cylinder. A pusher is received in the housing and has a follower pin riding in the cam track to convert rotational movement of the cylinder to linear movement of the pusher for actuating an electrical switch, in use. A ring gasket surrounds the knob and is received in the barrel housing. The ring gasket includes a wiper seal engaging an inner wall of the housing to prevent water entry into the housing.

It is a feature of the invention that the ring gasket is U-shaped in cross section. The gasket includes an inner cylindrical wall and end wall engaging the knob and an outer cylindrical wall engaging the inner wall of the housing. The ring gasket is formed of rubber.

It is another feature of the invention to provide a panel gasket surrounding an outer wall of the housing for sealing the housing in an enclosure panel, in use.

DETAILED DESCRIPTION OF THE INVENTION

Figure 1:
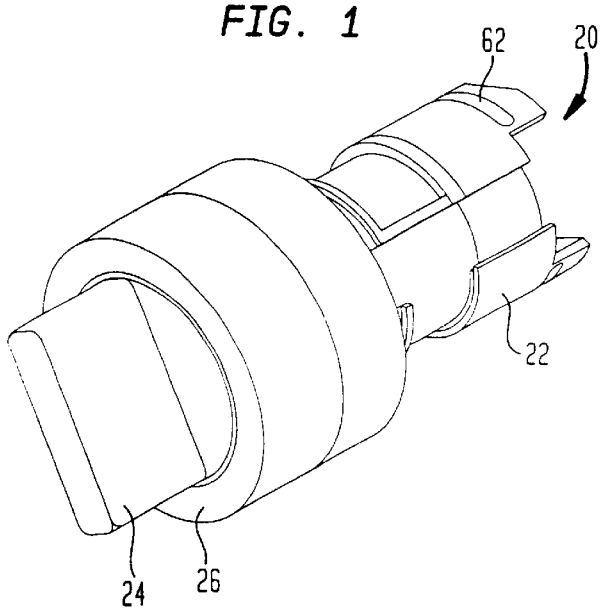
FIG. 1 is a perspective view of a selector switch operator in accordance with the invention.
Figure 2:
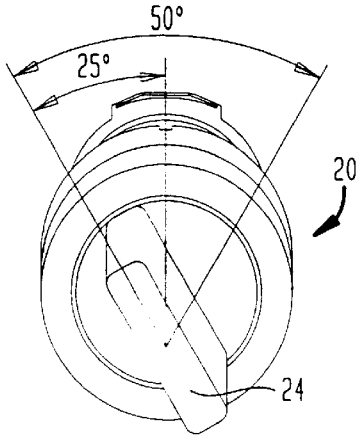
FIG. 2 is a front view of the selector switch operator of FIG. 1 adapted for a two position operation.
Figure 3:
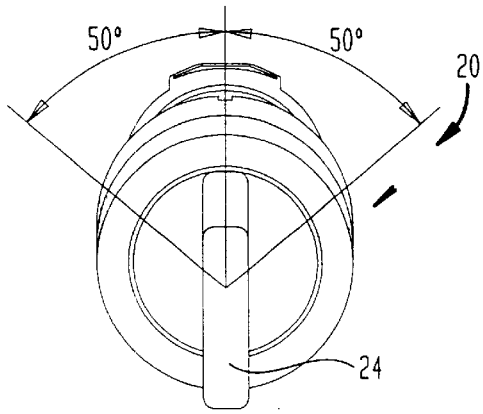
FIG. 3 is a front view of the selector switch operator of FIG. 1 adapted for a three position operation.

Referring initially to FIG. 1 a selector switch operator 20 in accordance with the invention is illustrated. The selector switch operator 20 is for a NEMA 22 mm selector switch that meets the ratings of the NEMA 4 water spray test and the NEMA 6 water submersion test. However, the features of the invention are not limited strictly to a 22 mm selector switch. Also, the selector switch operator 20 has a reduced number of unique components required for manufacture of all six standard NEMA industry two and three position selector switch actuation configurations, enhancing manufacturing economies of scale. FIG. 2 illustrates the selector switch operator 20 configured for two position operation, while FIG. 3 illustrates the selector switch operator 20 configured for three position operation.

Figure 4:
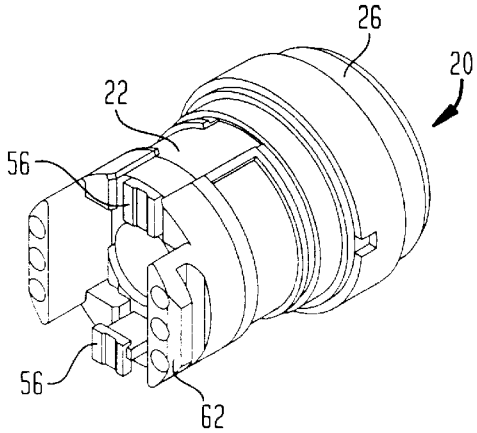
FIG. 4 is a rear perspective view of the selector switch operator of FIG. 1.
Figures 5, 6, 13:
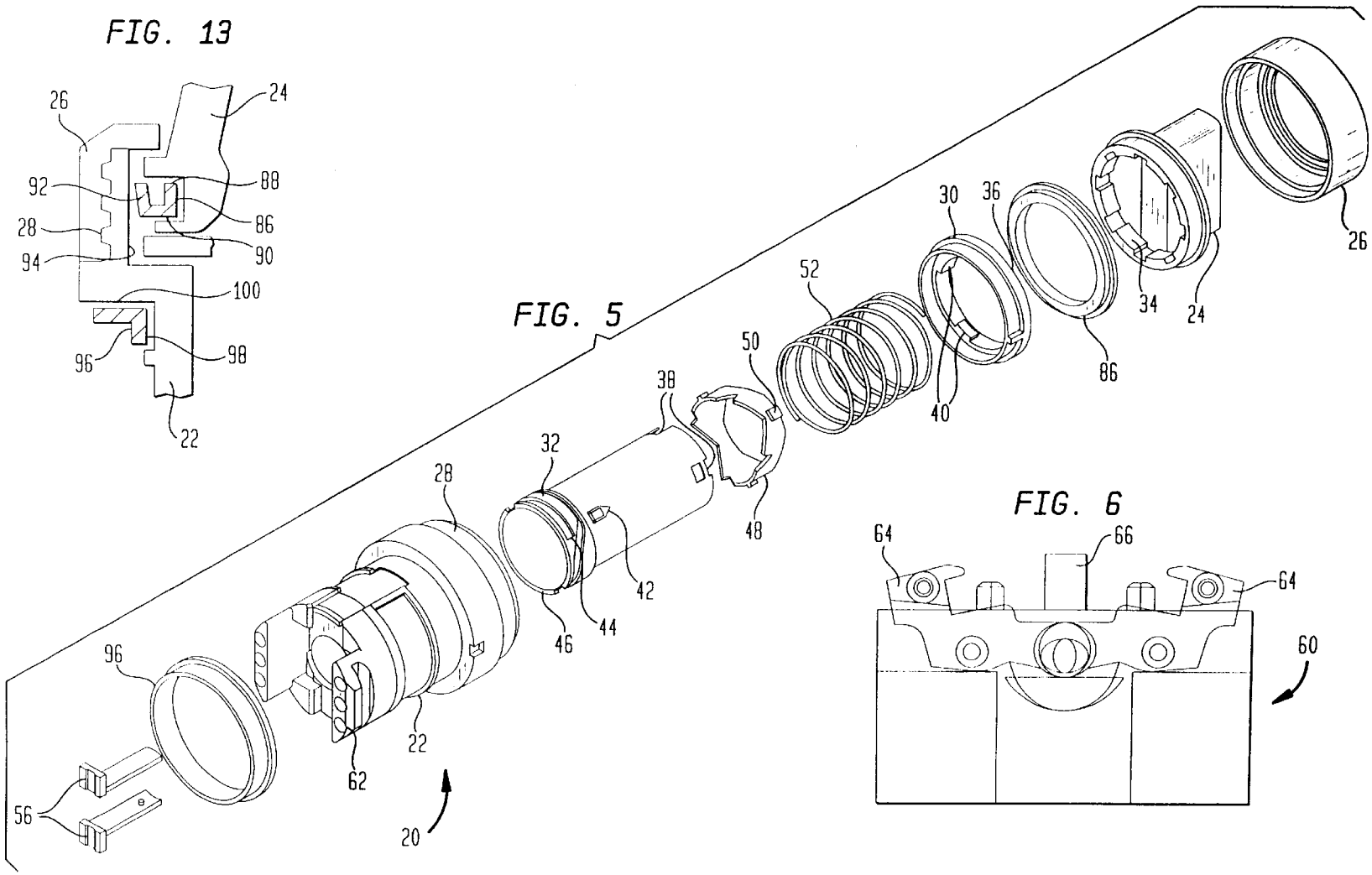
FIG. 5 is an exploded perspective view of the selector switch operator of FIG. 3.
FIG. 6 is a side view of a contact block used with the selector switch operator of FIG. 1.
FIG. 13 is a sectional view illustrating gasket operation for the selector switch of FIG. 1

Referring also to FIGS. 4 and 5, the selector switch operator 20 includes a one-piece tubular barrel housing 22. A rotary knob 24, used for switch actuation, extends forwardly of the housing 22 and is retained by a front ring 26 screwed onto the housing 22 at a threaded outer front end wall 28, see also FIG. 13. The knob 24 is seated on a cap 30 that couples rotation of the knob 24 to a cylinder 32 internal to the housing 22. Particularly, the knob 24 includes an inner notched cylindrical surface 34. The cap 30 extends into the knob 24 and has an outer radial tooth 36 engaging the notched surface 34 to be rotational therewith.

The cylinder 32 is telescopically received in the cap 30 and has front end notches 38 receiving inner radial teeth 40 of the cap 30 to be rotational therewith. Thus rotation of the knob 24 causes rotation of the cylinder 32 in the housing 22. Two pointed cam followers 42, one of which is shown, are on opposite sides of the cylinder 32. A circumferential cam track 44 extends around the cylinder 32 at a rear end 46. The followers 42 support and slide radially over an indexing cam ring 48 externally concentric to the cylinder 32 in the housing 22. The cam ring 48 is rotationally constrained by tabs 50 received in axially extending grooves, not shown, on an inner wall of the housing 22. A helical compression spring 52, between the cap 30 and the cam ring 48, biases the cam ring 48 against the cylinder followers 42.

Rotation of the knob 24, and thus cylinder 32, causes the followers 42 to move the cam ring 48 from a rest or neutral position, described below, axially toward the knob 24 compressing the spring 52. The reaction load of the compressed spring 52 against the cam ring 48 is translated through the cylinder followers 42 into a return torque that rotates the cylinder 32 and the knob 24 back to the neutral position. Detents or notches, discussed below, on the cam ring 48 can engage the followers 42 and lock the cam ring 48 to the cylinder 32 providing maintained actuation of the switch operator 20. Conversely, the lack of a notch on the cam ring 48 permits the spring-biased cam ring 48 and follower action to spring-return to the neutral position, providing momentary action of the switch operator.

For the two position switch operator configuration shown in FIG. 2, the neutral position is twenty-five degrees counter-clockwise from "12 O'clock". The actuation position is to the right, fifty degrees clockwise. For the three position switch operator configuration shown in FIG. 3, the neutral position is centered at "12 O'clock". The left actuation position is fifty degrees counter-clockwise. The right actuation position is fifty degrees clockwise. The six following switch actuation configurations are possible:

two positions, maintained right;

two positions, momentary right;

three positions, maintained left and right;

three positions, momentary left and right;

three positions, maintained left, momentary right; and three positions, momentary left, maintained right.

Figure 9:
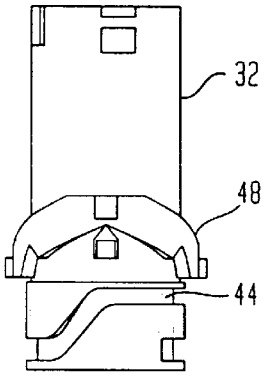
Figure 10:
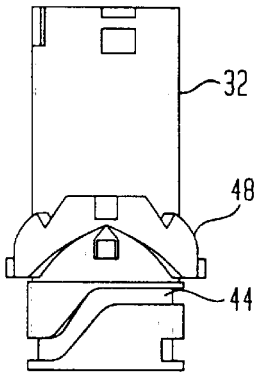
Figure 11:
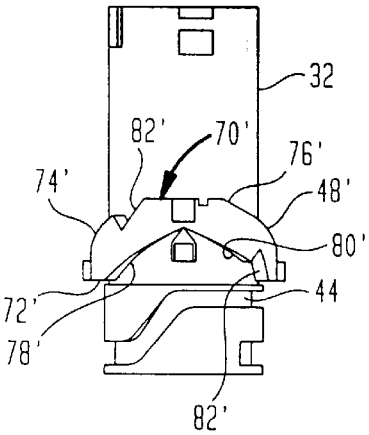
Figure 12:
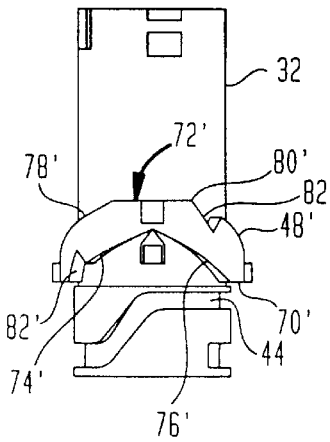

In accordance with the invention, one version of the cam ring 48 is used for the first four configurations, shown in FIGS. 7–10, while a second version cam ring 48' is used for the last two configurations, shown in FIG. 11 and 12.

A set of axial grooves 54, see FIG. 5, one of which is shown, in the housing 22 slidably receive a pair of pushers 56. The grooves 54 radially constrain the pushers 56. Each pusher 56 includes a radially inwardly extending follower pin 58. Each follower pin 58 is received in and engages the cylinder cam tracks 44. Cylinder rotation extends and retracts the pushers 56 axially from the housing 22, as illustrated by the two positions in FIG. 4. The sequence of pusher action is determined be the cam track pattern. The one cylinder version 32 is used for three position switches, see FIGS. 9–12. Another cylinder version 32' is used for two position switches, see FIGS. 7 and 8. The cam track 44 is adapted to retract both pushers 56 in the neutral position, extend one pusher 56 in the left position and extend the other pusher 56 in the right position. A portion of the cam track 44 receives a tab in the housing 22 to axially constrain the cylinder in the housing. Similarly, the cylinder 32' includes a cam track 44' adapted to retract both pushers 56 in the neutral position and extend both pushers 56 in the right position. A portion of the cam track 44' receives a tab in the housing 22 to axially constrain the cylinder in the housing.

A contact block 60, see FIG. 6, having an internal electrical switch, is mounted on base feet 62 of the housing 22 using snap-fit toggle linkages 64 integral to the contact block 60, as is known. Actuation of the knob 24, which is coupled to the cylinder 32, extends the pushers 56 from the housing 22 depressing a contact block plunger 66 causing the electrical switch to switch electrical states. The housing 22 can support up to three contact blocks 60 for separate or simultaneous actuation by the two pushers 56.

Figure 7:
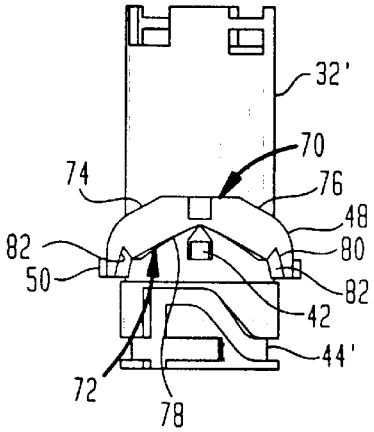
FIGS. 7–12 illustrate cylinder and indexing cam ring combinations used with the selector switch operator of FIG. 1.
Figure 8:
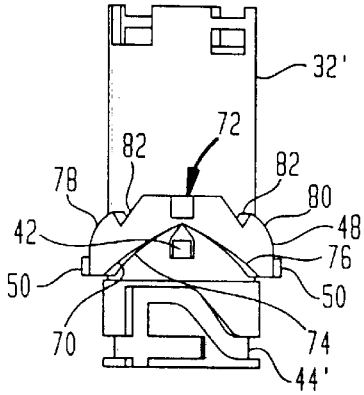

The cam ring 48 includes first and second axial end surfaces 70 and 72, see FIGS.7 and 8. The first axial end surface 70 includes opposite pairs of intersecting ramped surfaces 74 and 76. Similarly, the second axial end surface 72 includes opposite pairs of intersecting ramped surfaces 78 and 80. Each of the intersecting ramped surfaces 78 and 80 has detents 82. The cam ring 48 can be positioned in a first orientation, as shown in FIGS. 7 and 9 to provide maintained actuation or in a second orientation, as shown in FIGS. 8 and 10 to provide momentary actuation. In the first orientation the cam followers 42 engage the second axial end surface 72 having the detents 82. In the second orientation the cam followers 42 engage the first axial end surface 70 having no detents. Thus, turning the cam ring 48 upside down 180 degrees and rotating 90 degrees converts the selector switch operator 20 from momentary operation to maintained operation, and vice-versa.

The cam ring 48' includes first and second axial end surfaces 70' and 72', see FIGS. 11 and 12. The first axial end surface 70' includes opposite pairs of intersecting ramped surfaces 74' and 76'. Similarly, the second axial end surface 72' includes opposite pairs of intersecting ramped surfaces 78' and 80'. Each of the intersecting ramped surfaces 74' and 80' have detents 82'. The cam ring 48' can be positioned in a first orientation, as shown in FIG. 11 to provide maintained actuation to the left or in a second orientation, as shown in FIG. 12 to provide maintained actuation to the right. Thus, turning the cam ring 48' upside down 180 degrees and rotating 90 degrees converts the selector switch operator 20 from left maintained operation to right maintained operation, and vice-versa. The selector switch operator 20 is sealed against internal water entry by a ring gasket 86 incorporating a wiper seal. The gasket 86 is U-shaped in cross section, see FIG. 13, and includes an inner cylindrical wall 88 and end wall 90 engaging the knob 24 and an outer cylindrical wall 92 engaging an inner wall 94 of the housing 22. The outer cylindrical wall 92 acts as a wiper seal to prevent water entry into the housing 22. The ring gasket 86 is formed of a neoprene rubber.

A panel gasket 96, having an L-shape in cross section, surrounds an outer wall 98 of the housing 22, at a shoulder 100, for sealing the housing 22 in an enclosure panel, in use. The gasket 96 may also be of neoprene rubber.

The use of common interchangeable components for multiple assembly configurations with different functional modes may be applicable to other mechanisms using rotary actuated cams for indexing and torsion driven biasing.

Thus, in accordance with the invention there is provided a selector switch operator having improved water resistance. The operator also has only two internal components varied to assemble six standard switch actuation configurations, and only two versions of each such component are required for all configurations.

I claim:

1. A modular selector switch operator including:

a housing;

a cylinder rotationally mounted in the housing and having a radially extending follower and a circumferential cam track;

a knob extending forwardly of the housing and operatively connected to the cylinder for rotating the cylinder;

a pusher received in the housing and having a follower pin riding in the cam track to convert rotational movement of the cylinder to linear movement of the pusher, the pusher for actuating an electrical switch, in use; and an indexing cam ring concentrically mounted to the cylinder in the housing in one of two orientations with the cylinder follower engaging the cam ring, a first orientation providing a maintained actuation position relative to a neutral position and a second orientation providing a momentary actuation position relative to the neutral position.

2. The modular selector switch operator of claim 1 wherein the cam ring has plural ramped surfaces for riding on the follower, the ramped surfaces riding on the follower if in the first orientation including detents for locking the cylinder to the cam ring in the maintained actuation position.

3. The modular selector switch operator of claim 2 further comprising a spring biasing the cam ring against the follower.

4. The modular selector switch operator of claim 1 wherein the selector switch comprises a three position switch and the cylinder cam track limits movement of the cylinder to approximately 100 degree rotation.

5. The modular selector switch operator of claim 1 the selector switch comprises a two position switch and the cylinder cam track limits movement of the cylinder to approximately 50 degree rotation.

6. The modular selector switch operator of claim 1 wherein the cam ring includes first and second axial end surfaces each having plural ramped surfaces, the ramped surfaces at the first axial end having detents, wherein the first axial end surface engages the follower in the first orientation and the second axial end surface engages the follower in the second orientation.

7. The modular selector switch operator of claim 1 wherein the cam ring is rotationally constrained in the housing.

8. The modular selector switch operator of claim 1 wherein the cam ring includes first and second axial end surfaces each having opposite pairs of intersecting ramped surfaces, one of each of the intersecting ramped surfaces having a detent, wherein the follower is positioned proximate the intersection of the ramped surfaces in the neutral position and surface having the detent is clockwise from the intersection in the first orientation and counterclockwise from the intersection in the second orientation.

9. A selector switch operator including:

a one-piece tubular barrel housing;

a cylinder rotationally mounted in the housing and having a radially extending follower and a circumferential cam track;

a knob extending forwardly of the housing and operatively connected to the cylinder for rotating the cylinder;

a pusher received in the housing and having a follower pin riding in the cam track to convert rotational movement of the cylinder to linear movement of the pusher, the pusher for actuating an electrical switch, in use; and a ring gasket surrounding the knob and received in the barrel housing, the ring gasket including a wiper seal engaging an inner wall of the housing to prevent water entry into the housing.

10. The selector switch operator of claim 9 wherein the ring gasket is U-shaped in cross section.

11. The selector switch operator of claim 10 wherein the gasket includes an inner cylindrical wall and end wall engaging the knob and an outer cylindrical wall engaging the inner wall of the housing.

12. The selector switch operator of claim 9 further comprising a panel gasket surrounding an outer wall of the housing for sealing the housing in an enclosure panel, in use.

13. The selector switch operator of claim 9 wherein the ring gasket is formed of rubber.

* * * * *